US011823853B2

(12) United States Patent
Heimann et al.

(10) Patent No.: US 11,823,853 B2
(45) Date of Patent: Nov. 21, 2023

(54) MEMBRANE PRESSURE SWITCH

(71) Applicant: INELTA SENSORSYSTEME GMBH & CO. KG, Taufkirchen (DE)

(72) Inventors: Jochen Heimann, Neubiberg (DE); Michael Fiala, Seefeld (DE)

(73) Assignee: Inelta Sensorsysteme Gmbh & Co. KG, Taufkirchen (DE)

( * ) Notice: Subject to any disclaimer, the term of this patent is extended or adjusted under 35 U.S.C. 154(b) by 0 days.

(21) Appl. No.: 17/637,394

(22) PCT Filed: Aug. 20, 2020

(86) PCT No.: PCT/EP2020/073328

§ 371 (c)(1),
(2) Date: Feb. 22, 2022

(87) PCT Pub. No.: WO2021/037665

PCT Pub. Date: Mar. 4, 2021

(65) Prior Publication Data

US 2022/0285112 A1 Sep. 8, 2022

(30) Foreign Application Priority Data

Aug. 23, 2019 (DE) ..... 102019212681.2

(51) Int. Cl.
*H01H 35/26* (2006.01)
*H01H 35/34* (2006.01)

(52) U.S. Cl.
CPC ..... *H01H 35/2628* (2013.01); *H01H 35/34* (2013.01)

(58) Field of Classification Search
CPC ..... H01H 35/34; H01H 35/24; H01H 35/245; G01L 9/0041; G01L 9/0044
See application file for complete search history.

(56) References Cited

U.S. PATENT DOCUMENTS 3,619,526 A 11/1971 Riley
4,616,114 A * 10/1986 Strasser ..... H01H 35/34 200/83 J (Continued)

FOREIGN PATENT DOCUMENTS

DE 1148623 A 5/1963
DE 69211955 T2 2/1997

(Continued)

OTHER PUBLICATIONS

International Patent Application No. PCT/EP2020/073328, International Search Report and Written Opinion dated Nov. 26, 2020, 15 pages.

*Primary Examiner* — Vanessa Girardi
(74) *Attorney, Agent, or Firm* — Kilpatrick Townsend & Stockton LLP

(57) ABSTRACT

The invention relates to a membrane pressure switch (1) comprising a housing (2), in which a deformable membrane (3) is arranged, against which a mushroom shaped thrust element (4) abuts, which is movable by the deformation of the membrane (3); and a microswitch (5), which is arranged in the housing (2) opposite the mushroom shaped thrust element (4) by means of a fixing disk (6), wherein the fixing disk (6) is provided with an external thread (7), which is screwed into an internal thread (8) of the housing (2) in the mounted state of the fixing disk (6).

7 Claims, 2 Drawing Sheets

(56) References Cited

U.S. PATENT DOCUMENTS

| | | | | |
|---|---|---|---|---|
| 4,827,095 | A * | 5/1989 | Clark | H01H 35/24 200/82 C |
| 4,900,883 | A * | 2/1990 | Brame | H01H 35/2614 73/861.47 |
| 7,112,753 | B1 * | 9/2006 | Lee | H01H 35/34 200/81 R |
| 8,653,387 | B2 * | 2/2014 | Bessette | H01H 35/2628 200/83 Z |
| 10,510,504 | B2 * | 12/2019 | Johnson | H01H 35/34 |
| 2012/0007732 | A1 | 1/2012 | Bessette et al. | |
| 2019/0180965 | A1 | 6/2019 | Johnson et al. | |

FOREIGN PATENT DOCUMENTS

| | | | |
|---|---|---|---|
| DE | 19701584 | A1 | 7/1998 |
| DE | 20106436 | U1 | 6/2001 |
| WO | 2005100792 | A1 | 10/2005 |

* cited by examiner

B-B

MEMBRANE PRESSURE SWITCH

The invention relates to a membrane pressure switch according to the preamble of claim 1.

Such a membrane pressure switch is known from DE 201 06 436 U1. This pressure switch comprises an insulating housing, which is provided at the end surface with at least two essentially axially parallel, radially elastic anchor tongues with gripper hooks, which engage a ring surface of a hexagonal nut.

In contrast, it is the purpose of the present invention to develop a typical membrane pressure switch, the design of which is technically simpler.

This solution for this purpose is provided by the features of claim 1.

In detail, a membrane pressure switch is developed according to the invention, which is provided with a housing, in which a deformable membrane is arranged. Furthermore, a mushroom shaped thrust element is provided in the housing, which is movable by deformation of the membrane and for this purpose abuts against the membrane. If pressure is applied to the membrane, for example by a pressurized fluid, the membrane deforms and presses on the mushroom shaped thrust element, so that the latter can be moved along the longitudinal axis of the housing from a standby position to a switching position.

In this switching position, the mushroom shaped thrust element actuates a switching operation of a microswitch, which is arranged opposite the mushroom shaped thrust element by means of a fixing disk in the housing.

According to the invention, the fixing disk is provided with an external thread, which is screwed into an internal thread of the housing in the mounted state of the fixing disk.

Compared with known pressure switches, such as the typical pressure switch in particular, results in the advantage of a smaller number of parts and a considerable simplification of assembly.

These further results in the advantage that the typical membrane pressure switch according to the invention can be manufactured at lower cost and is easy to operate.

The dependent claims contain further advantageous embodiments of the invention.

Further details, advantages and features of the present invention will be apparent in the following description of an embodiment based on the drawing.

FIG. 1 shows a front view of a membrane pressure switch 1 according to the invention and illustrates the section lines A-A and B-B, resulting in the sectional views of FIGS. 2 and 3.

Figure 1:
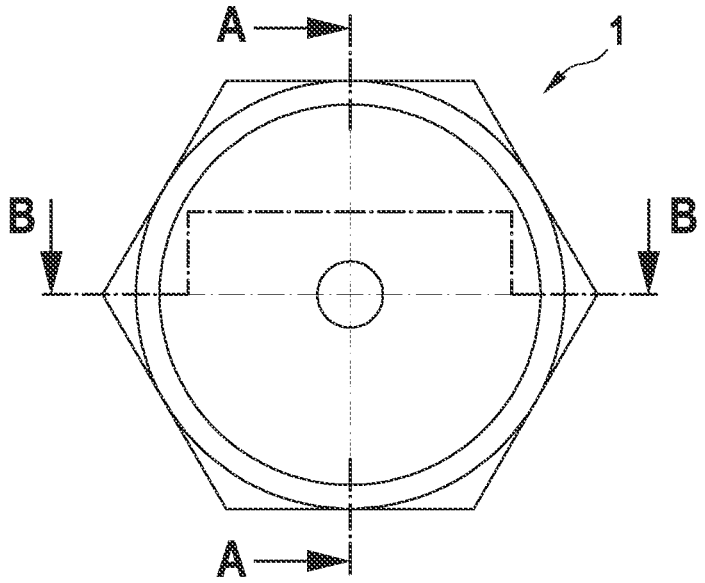
FIG. 1 shows a front view of a membrane pressure switch according to the invention.
Figure 2:
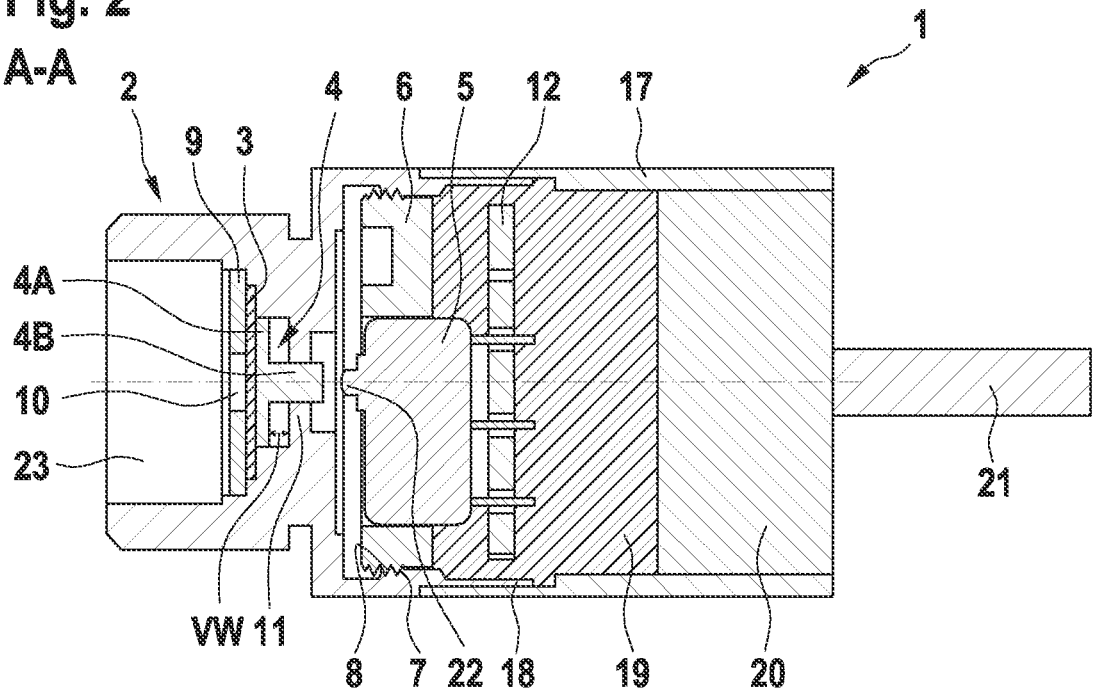
FIG. 2 shows a sectional view of the membrane pressure switch along line A-A in FIG. 1.
Figure 3:
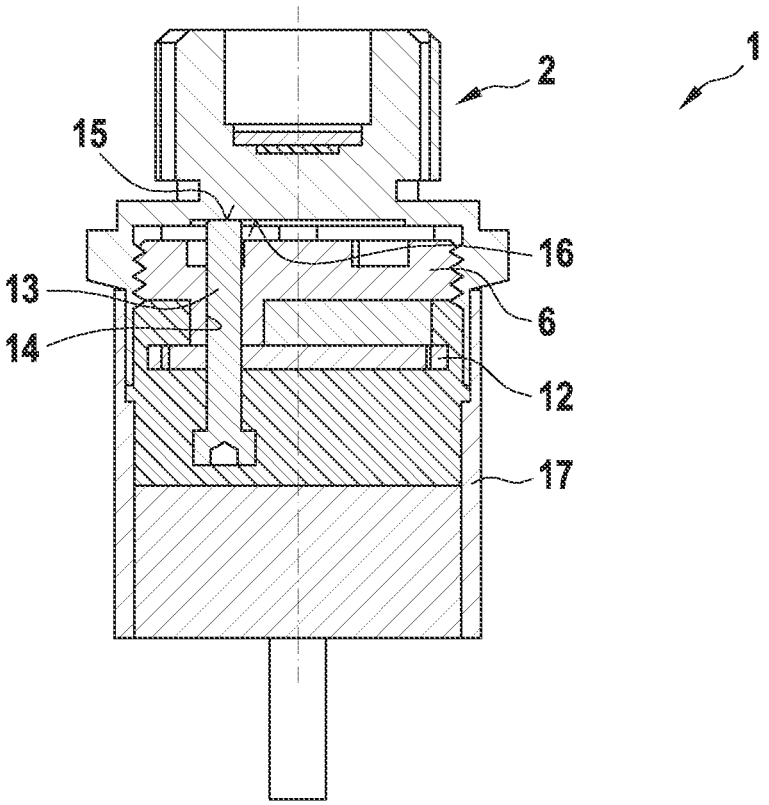
FIG. 3 shows a sectional view of the membrane pressure switch according to FIG. 1 along the line B-B in FIG. 1.

From a combined view of FIGS. 1 to 3, it is clear that the membrane pressure switch 1 comprises a housing 2, in which a membrane 3 is arranged, which can be fixed in the housing 2 by means of an adjusting washer 9 arranged on the membrane 3.

The membrane 3 is deformable, such as by a fluid introduced into a pressure chamber 23, for which purpose the adjusting washer 9 comprises a preferably centric recess 10.

As shown in FIG. 2, a mushroom shaped thrust element 4 is further arranged in the housing 2, which comprises an abutment disk 4A and a plunger 4B attached to the abutment disk 4A. The mushroom shaped thrust element 4 abuts the membrane 3 with its abutment disk 4A and can move along a movement path indicated by the double arrow VW in FIG. 2 in the direction of an actuating element 22 of a microswitch 5, which is arranged and fixed opposite to the mushroom shaped thrust element by means of a fixing disk 6 in the housing 2.

The fixing disk 6 is provided with an external thread 7, which can cooperate with an internal thread 8 of the housing 2, so that the fixing disk 6 and the microswitch 5 arranged thereon are screwed into the housing 2 in the mounted state.

Preferably, the microswitch 5 is sealingly glued to the fixing disk 6.

As further shown in FIG. 2, an end stop 11 for the mushroom shaped thrust element 4 is provided in the housing 2, which limits the movement path VW thereby, that in the end position the abutment disk 4A is arranged on the stop 11.

As further shown in FIG. 2, the microswitch 5 is connected to a printed circuit board 12, which is also arranged in the housing 2.

Finally, FIG. 2 shows that a tube 17 is plugged onto a free end portion 18 of the housing 2 on the side of the microswitch 5, wherein in the final mounted state shown in FIG. 2 a connecting cable 21 is soldered onto the printed circuit board 12 and two potting compounds 19 and 20 are filled into the tube 17. The potting compound 19 here is a viscous plastic compound, so that it can be prevented that this potting compound 19 can penetrate into the threads 7 and 8, which are screwed together.

The second potting compound 20 is a plastic compound suitable for UL-certification.

FIG. 3 shows that a counter screw 13 is also screwed through the printed circuit board 12 into an internal thread 14 of the fixing disk 6. In this screwed-in state, the counter screw 13 is supported with its front end surface 15 on a bottom surface 16 of the housing 2. This results in a jamming of the external thread 7 relative to the internal thread 8, which determines the position of the fixing disk 6 and thereby of the microswitch 5 in the housing 2.

Figure 4:
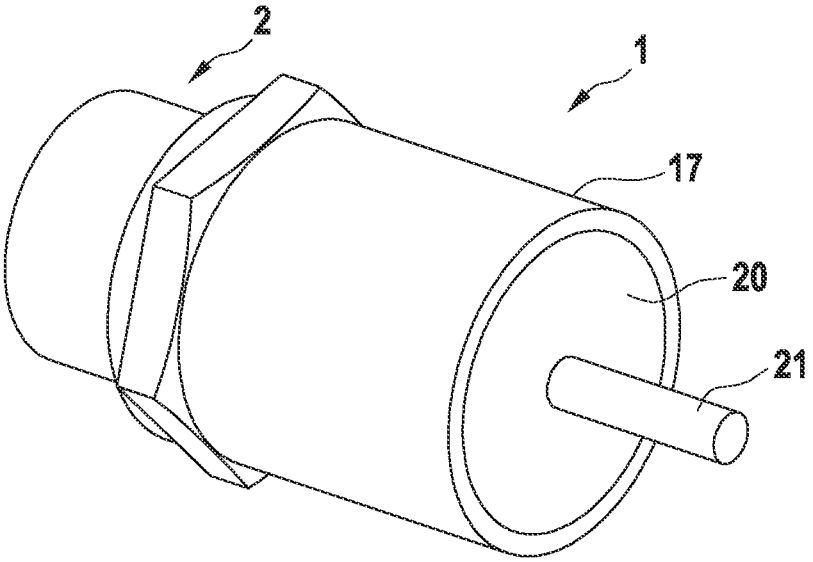
FIG. 4 shows a perspective view of the membrane pressure switch according to the invention.

In addition to the membrane pressure switch 1 described above, shown in perspective view in the final mounted state in FIG. 4, the present invention further relates to a method for adjusting a switching point of a membrane pressure switch.

This process comprises the following method steps:

Applying pressure in the pressure chamber 23 of the housing 2, which causes deformation of the membrane 3 and movement of the mushroom shaped thrust element 4 in the direction of the end stop 11.

In the next method step, the fixing disk 6 with the microswitch 5 fixed on it is screwed into the housing 2, until the microswitch 5 is switched by the mushroom shaped thrust element 4.

Preferably, this switching of the microswitch 5 can be indicated on a suitable assembly tool.

In the final assembly step, the counter screw 13 is screwed through the printed circuit board 12 into the internal thread 14 of the fixing screw 6, until the end surface 15 is supported on the bottom surface 16 of the housing 2. As previously described, this results in a jamming of the internal thread 8 of the housing 6 relative to the external thread 7 of the fixing disk 6, thereby fixing the fixing disk 6 and consequently fixing the switching point of the microswitch.

In addition to the foregoing written description of the invention, explicit reference is hereby made to the graphical representation of the invention in FIGS. 1 to 4 for supplementary disclosure thereof.

LIST OF REFERENCE SIGNS

1 membrane pressure switch
2 housing
3 membrane
4 mushroom shaped thrust element
4*a* abutment disk
4*b* plunger
5 microswitch
6 fixing disk
7 external thread
8 internal thread
9 adjusting washer
10 centric recess
11 end stop/stop
12 printed circuit board
13 counter screw
14 internal thread
15 front surface
16 bottom surface
17 tube
18 end portion
19, 20 potting compounds
21 connecting cable
22 switching pin/actuating element
23 pressure chamber
vw movement of the mushroom shaped thrust element 4

The invention claimed is:

1. A method for adjusting a switching point of a membrane pressure switch, wherein the membrane pressure switch comprises:

a housing, in which a deformable membrane is arranged, at which a mushroom shaped thrust element abuts, which is movable by the deformation of the membrane; and a microswitch, which is arranged in the housing opposite the mushroom shaped thrust element by a fixing disk, characterized in that the fixing disk is provided with an external thread, which is screwed into an internal thread of the housing in a mounted state of the fixing disk, and wherein the method comprises:

Applying pressure in a pressure chamber of the housing and deforming the membrane and moving the mushroom shaped thrust element into a switching position;

Screwing the fixing disk with the microswitch fixed thereon until the microswitch is switched by the mushroom shaped thrust element;

Preferably indicating the switching of the microswitch; and

Screwing a counter screw into the fixing disk until an end surface of the counter screw is supported on a bottom surface of the housing and thereby the internal thread of the housing and the external thread of the fixing disk are jammed relative to each other to fix the fixing disk and thus to fix the switching point.

2. A membrane pressure switch comprising:

a housing, in which a deformable membrane is arranged, at which a mushroom shaped thrust element abuts, which is movable by the deformation of the membrane; and a microswitch, which is arranged in the housing opposite the mushroom shaped thrust element by a fixing disk, characterized in that the fixing disk is provided with an external thread, which is screwed into an internal thread of the housing in a mounted state of the fixing disk, the microswitch is connected to a printed circuit board, and a counter screw is screwed through the printed circuit board into an internal thread of the fixing disk, which is supported with its front end surface on a bottom surface of the housing.

3. The membrane pressure switch according to claim 2, characterized in that the microswitch is sealingly glued to the fixing disk.

4. The membrane pressure switch according to claim 2, characterized in that an end stop for the mushroom shaped thrust element is arranged in the housing.

5. The membrane pressure switch according to claim 2, characterized in that a tube on side of the microswitch is plugged onto a free end portion of the housing and that two potting compounds are filled into the tube.

6. The membrane pressure switch according to claim 2, characterized in that a adjusting washer is placed on the membrane and is fixed in the housing.

7. The membrane pressure switch according to claim 6, characterized in that the adjusting washer comprises a central recess.

* * * * *